US010451380B2

(12) United States Patent
Vanek et al.

(10) Patent No.: US 10,451,380 B2
(45) Date of Patent: Oct. 22, 2019

(54) ADJUSTABLE STOCK SYSTEMS FOR FIREARMS

(71) Applicants: Joede Vanek, Stevensville, MT (US); Bret Pitman, Las Vegas, NV (US)

(72) Inventors: Joede Vanek, Stevensville, MT (US); Bret Pitman, Las Vegas, NV (US)

(73) Assignee: Auto X Ops, LLC, Las Vegas, NV (US)

( * ) Notice: Subject to any disclaimer, the term of this patent is extended or adjusted under 35 U.S.C. 154(b) by 182 days.

(21) Appl. No.: 15/452,377

(22) Filed: Mar. 7, 2017

(65) Prior Publication Data

US 2019/0017774 A1 Jan. 17, 2019

Related U.S. Application Data

(60) Provisional application No. 62/307,404, filed on Mar. 11, 2016.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14; F41C 23/04
USPC ..... 42/73, 72, 71.01
See application file for complete search history.

(56) References Cited

U.S. PATENT DOCUMENTS 3,442,042 A * 5/1969 Van Tyle ..... F41C 23/00 42/71.01
4,327,626 A * 5/1982 McQueen ..... F41A 3/54 42/72
6,839,998 B1 * 1/2005 Armstrong ..... F41C 23/00 42/71.01

(Continued)

FOREIGN PATENT DOCUMENTS

DE 1225517 B 9/1966
KR 200409586 Y1 2/2006

(Continued)

OTHER PUBLICATIONS

International Search Report issued by Authorized Officer Maarten Giesen, of the European Patent Office as ISA, dated Aug. 21, 2017, in corresponding International Patent Application No. PCT/US2017/021113.

*Primary Examiner* — Reginald S Tillman, Jr.
(74) *Attorney, Agent, or Firm* — Locke Lord LLP; Daniel J. Fiorello

(57) ABSTRACT

An adjustable stock system for a firearm includes a buttstock configured to be slidably attached to the firearm for moving relative to the firearm between a collapsed position and at least one extended position, wherein the buttstock includes a plurality of buttstock grooves defined therein. The system also includes a lever having at least one lever tooth configured to mate with the plurality of buttstock grooves in a latched position. The lever is configured to mount to the firearm and to be moveable relative to the buttstock between the latched position where the buttstock cannot slide relative to the firearm, and an unlatched position where the buttstock is free to slide relative to the firearm, wherein the lever is biased to the latched position. The system also includes an actuator configured to move the lever between the latched position and the unlatched position.

15 Claims, 19 Drawing Sheets

(56) References Cited

U.S. PATENT DOCUMENTS

| | | | | |
|---|---|---|---|---|
| 7,984,580 | B1 | 7/2011 | Giauque et al. | |
| 8,677,669 | B1 * | 3/2014 | Vesligaj | F41C 23/04 42/71.02 |
| 8,991,088 | B1 | 3/2015 | Young | |
| 9,347,739 | B2 * | 5/2016 | Gomirato | F41C 23/04 |
| 9,612,083 | B2 * | 4/2017 | Cottle | F41C 23/14 |
| 9,746,281 | B2 * | 8/2017 | Wilson | F41C 23/04 |
| 9,766,034 | B2 * | 9/2017 | Huang | F41C 23/04 |
| 10,054,394 | B2 * | 8/2018 | Jen | F41C 23/14 |
| 2011/0283584 | A1 | 11/2011 | Walters | |
| 2016/0069636 | A1 * | 3/2016 | Gomirato | F41C 23/14 42/73 |
| 2017/0205190 | A1 * | 7/2017 | Jen | F41C 23/14 |

FOREIGN PATENT DOCUMENTS

| | | | |
|---|---|---|---|
| KR | 20080004805 | U | 10/2008 |
| WO | WO-2016115209 | A1 | 7/2016 |

* cited by examiner

ADJUSTABLE STOCK SYSTEMS FOR FIREARMS

CROSS-REFERENCE TO RELATED APPLICATIONS

This application claims priority to and the benefit of U.S. Provisional Application No. 62/307,404, filed Mar. 11, 2016, the entire contents of which are herein incorporated by reference in their entirety.

BACKGROUND

1. Field

The present disclosure relates to buttstocks, more specifically to adjustable stocks for firearms.

2. Description of Related Art

Traditional adjustable buttstocks require the user to take one or both hands off grip and/or trigger of the firearm to adjust the length of the stock. This action takes time, destabilizes the user's accuracy, and diminishes or eliminates the user's ability to fire the weapon while adjusting the length of their firearm. In a dangerous scenario where the user is exposed to a threat, such a disruptive action to adjust the length of the stock can mean the difference between life and death.

Such conventional methods and systems have generally been considered satisfactory for their intended purpose. However, there is still a need in the art for improved adjustable stock systems for firearms. The present disclosure provides a solution for this need.

SUMMARY

In accordance with at least one aspect of this disclosure, an adjustable stock system for a firearm includes a buttstock configured to be slidably attached to the firearm for moving relative to the firearm between a collapsed position and at least one extended position, wherein the buttstock includes a plurality of buttstock grooves defined therein. The system also includes a lever having at least one lever tooth configured to mate with the plurality of buttstock grooves in a latched position. The lever is configured to mount to the firearm and to be moveable relative to the buttstock between the latched position where the buttstock cannot slide relative to the firearm, and an unlatched position where the buttstock is free to slide relative to the firearm, wherein the lever is biased to the latched position. The system also includes an actuator configured to move the lever between the latched position and the unlatched position.

The lever can include a plurality of lever teeth configured to mate with the plurality of buttstock grooves in a latched position. The lever can be configured to be mounted to the firearm via a hinge.

The actuator can be configured to be positioned adjacent a grip of the firearm when the system is installed on a firearm such that a user can actuate the lever without removing a hand from the grip. In certain embodiments, the actuator can be configured to be positioned adjacent (e.g., above, below) a thumb of the user when the system is installed on the firearm such that the user's thumb can actuate the actuator. Any other suitable location for the actuator is contemplated herein.

The buttstock can be biased to the at least one extended position. In certain embodiments, the buttstock can be biased with one or more external springs mounted outside of the buttstock.

The buttstock can be biased with one or more internal springs disposed within the buttstock. In certain embodiments, the buttstock can be configured to be slidably mounted over a buffer tube of the firearm, and the internal spring is positioned between the buffer tube and an internal surface of the butt stock to bias the buttstock to the at least one extended position.

The system can further include an anchor system that is configured to be positioned in front of a castle nut of a buffer tube of the firearm in an open position, and to clamp around the buffer tube to be compressed by the castle nut in a closed position. The anchor system can include a base plate defining an opening dimensioned to slide over the buffer tube past the castle nut, and a pair of arms moveably mounted to the base plate to move between the open position and the closed position. The arms can clamp against the buffer tube in the closed position such that the castle nut can be compressed against the arms in a closed position to retain the anchor assembly.

In accordance with at least one aspect of this disclosure, an adjustable stock system for a firearm includes an actuator configured to allow a buttstock to move between a plurality of positions. The actuator can be configured to be positioned adjacent a grip of the firearm when the system is installed on the firearm such that a user can actuate the lever without removing a hand from the grip. The actuator can be configured to be positioned adjacent (e.g., above, below) a thumb (or any other suitable digit) of the user (of the user's gripping hand) when the system is installed on the firearm such that the user's thumb (or other digit) can actuate the actuator. In certain embodiments, the actuator can be configured to be at least one of pushed or pulled up, down, laterally, forward, and/or backward to cause actuation.

In certain embodiments, the actuator can be connected to a lever, the lever including at least one lever tooth configured to mate with a plurality of buttstock grooves in the buttstock in a latched position, the lever configured to mount to the firearm and to be moveable relative to the buttstock between the latched position where the buttstock cannot move relative to the firearm, and an unlatched position where the buttstock is free to move relative to the firearm, wherein the lever is configured to be biased to the latched position. The actuator can be configured to be pushed and/or pulled at least one of upward, downward, laterally, forward, and/or backward by the user's thumb and/or any other suitable digit to move the lever to the unlatched position.

The actuator can extend from the lever via one or more stems that bends off of a longitudinal axis of the lever and around the grip of the firearm. In certain embodiments, the actuator can include a duel stem extending from the lever to each side of the grip to allow ambidextrous actuation.

In accordance with at least one aspect of this disclosure, a stock system for a firearm can include an anchor system as described above. The system can further include at least one telescoping spring mechanism mounted at one end to the base plate, wherein an opposite end is mounted to a buttstock of the stock system to bias the buttstock to at least one extended position.

The system can further include a buffer tube collar fixed to the anchor system and configured to position around the buffer tube behind the castle nut and to prevent rotation of the anchor system about the buffer tube. The buffer tube collar can include a hinge, wherein the lever is mounted to the hinge to allow the lever to move between a latched position and an unlatched position.

In certain embodiments, the buffer tube collar can further include at least one guide rail extending therefrom, and a buttstock stop for stopping a buttstock at an extended position. The system can further include the buttstock, wherein the buttstock includes an internal spring disposed therein and configured to be positioned between the buffer tube and an internal surface of the butt stock to bias the buttstock to the at least one extended position.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 1O is a perspective view of the embodiment of FIG. 1A, shown in a collapsed position;

DETAILED DESCRIPTION

Figure 1A:
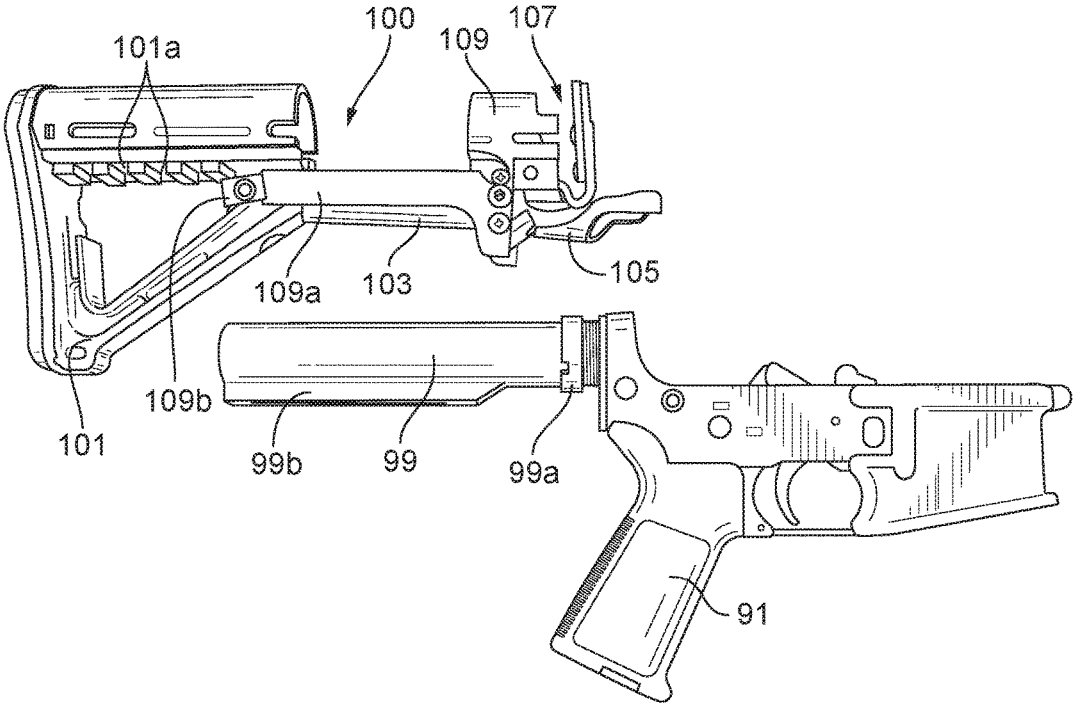
FIG. 1A is a side view of an embodiment of a system in accordance with this disclosure, shown separated from a receiver of a firearm.
Figure 1B:
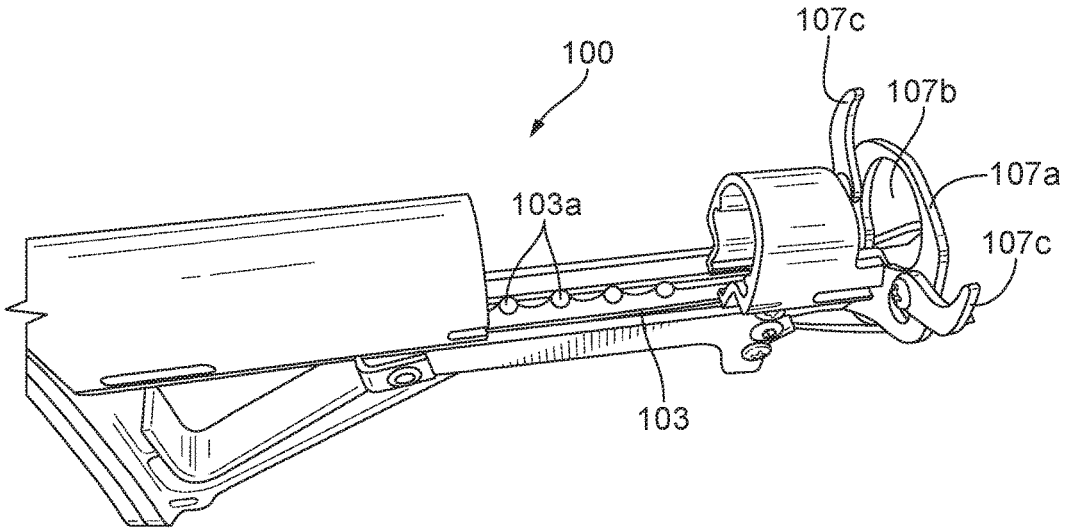
FIG. 1B is a top perspective view the embodiment of FIG. 1A, shown in an extended position and having an anchor system in an open position.

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIGS. 1A and 1*s* designated generally by reference character 100. Other embodiments and/or aspects of this disclosure are shown in FIGS. 1B-2B. The systems and methods described herein can be used to provide improved stock systems for firearms.

Figure 1C:
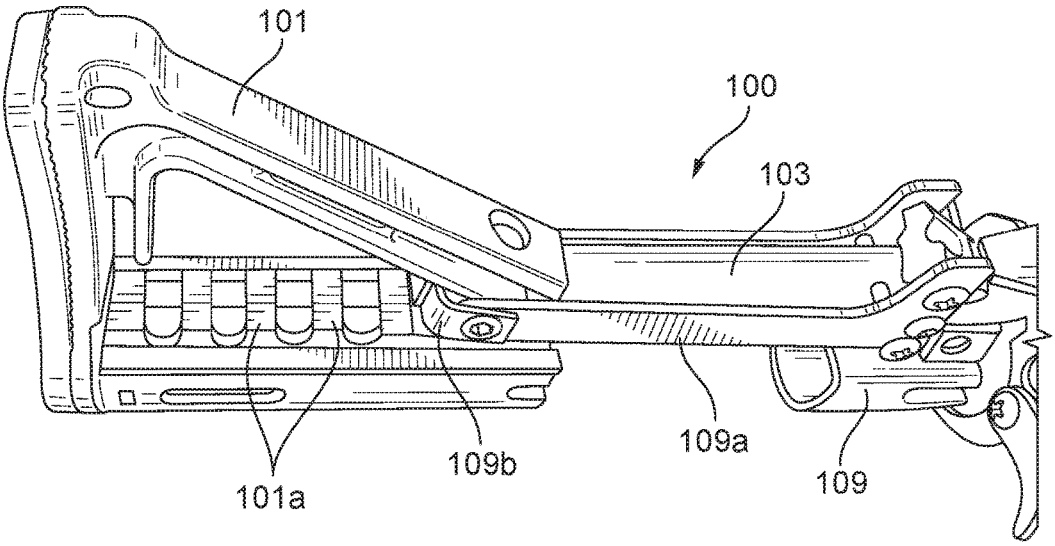
FIG. 1C is a bottom perspective view of the embodiment of FIG. 1A, shown in an extended position and having an anchor system in an open position.

In accordance with at least one aspect of this disclosure, referring FIGS. 1A-1O, an embodiment of an adjustable stock system 100 for a firearm is shown. The system 100 includes a buttstock 101 configured to be slidably attached to the firearm (e.g., a standard buffer tube 99 or any other suitable portion thereof) for moving relative to the firearm between a collapsed position (e.g., as shown in FIG. 1O) and at least one extended position (as shown in FIGS. 1A-1I). Referring additionally to FIG. 1C, the buttstock 101 includes a plurality of buttstock grooves 101*a* defined therein. The buttstock grooves 101*a* correspond to each extended position, so it is contemplated that any suitable number of buttstock grooves 101*a* of any suitable size can be used to define how many and/or how far apart each extended position is. The buttstock 101 can include any suitable features (e.g., a rubber shoulder pad) as appreciated by those skilled in the art.

Figure 1D:
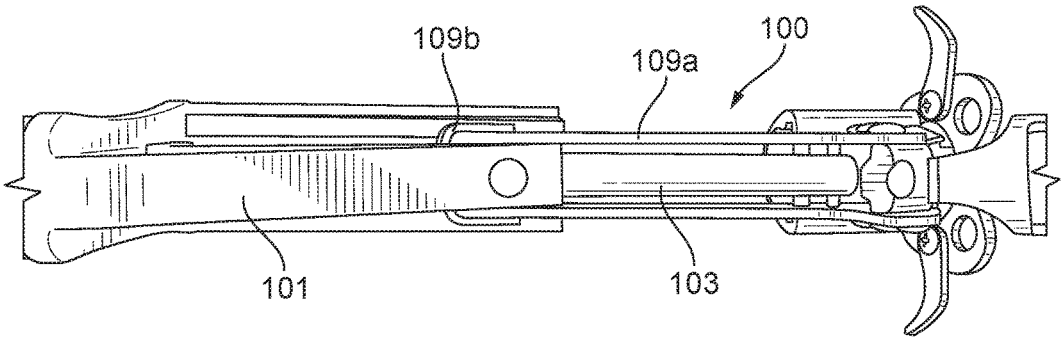
FIG. 1D is a bottom plan view of the embodiment of FIG. 1A, shown in an extended position and having an anchor system in an open position.
Figure 1E:
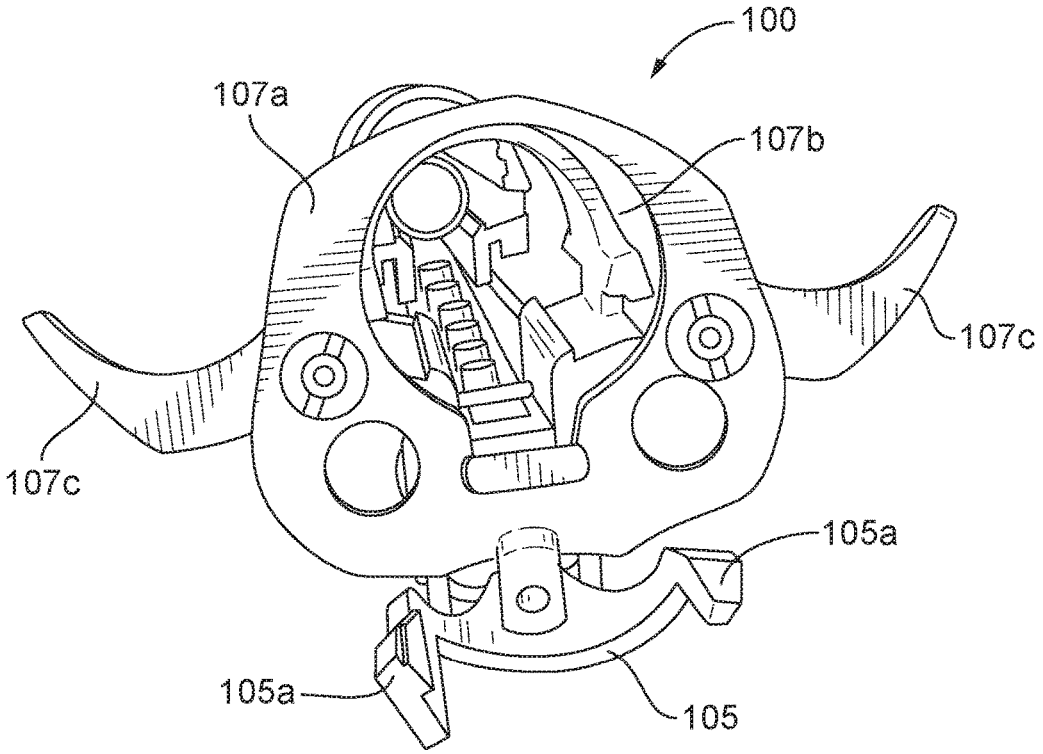
FIG. 1E is a front perspective view of the embodiment of FIG. 1A, shown in an extended position and having an anchor system in an open position.
Figure 1F:
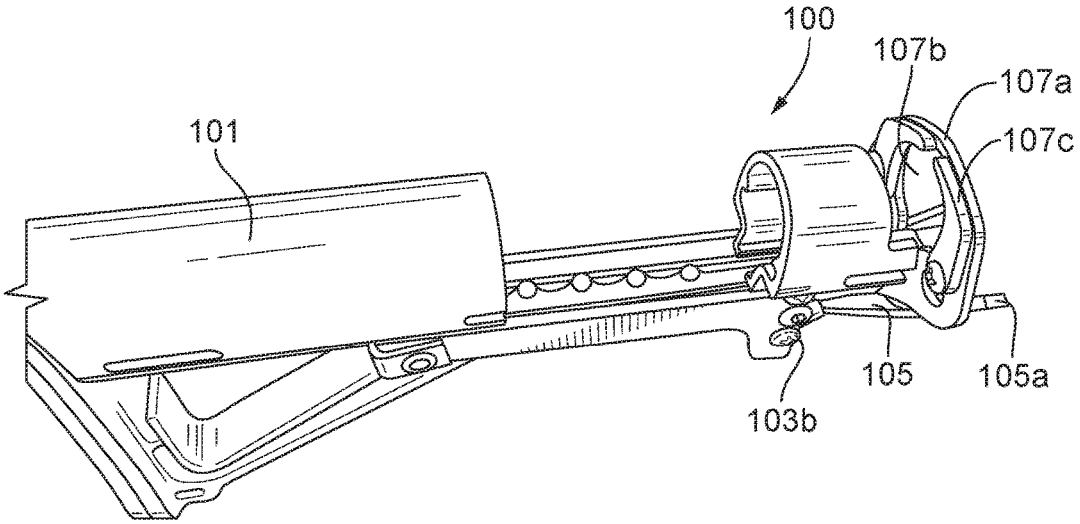
FIG. 1F is a top perspective view the embodiment of FIG. 1A, shown in an extended position and having an anchor system in a closed position.
Figure 1G:
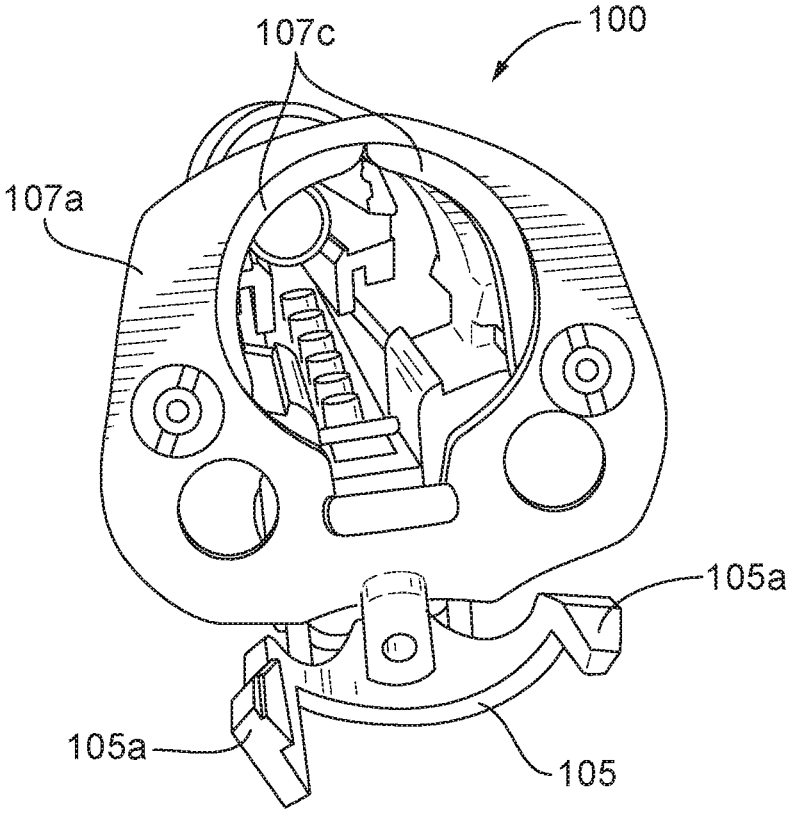
FIG. 1G is a front perspective view of the embodiment of FIG. 1A, shown in an extended position and having an anchor system in a closed position.
Figure 1H:
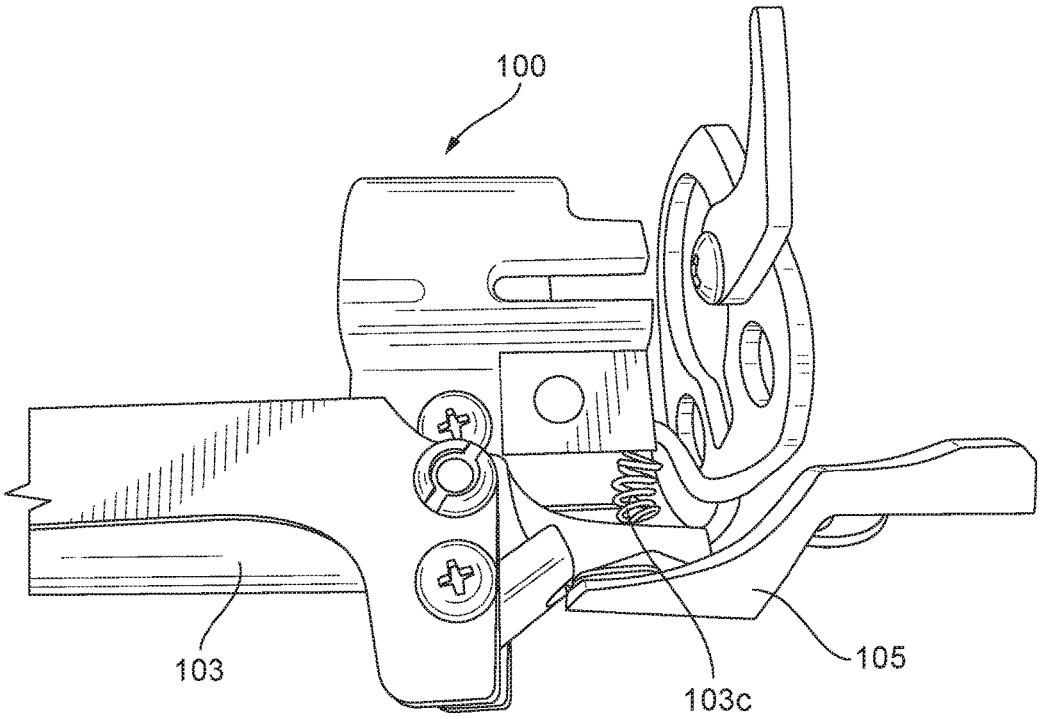
FIG. 1H is a side perspective view of the anchor system, lever, and actuator of the embodiment of FIG. 1A, shown in an unactuated position.
Figure 1I:
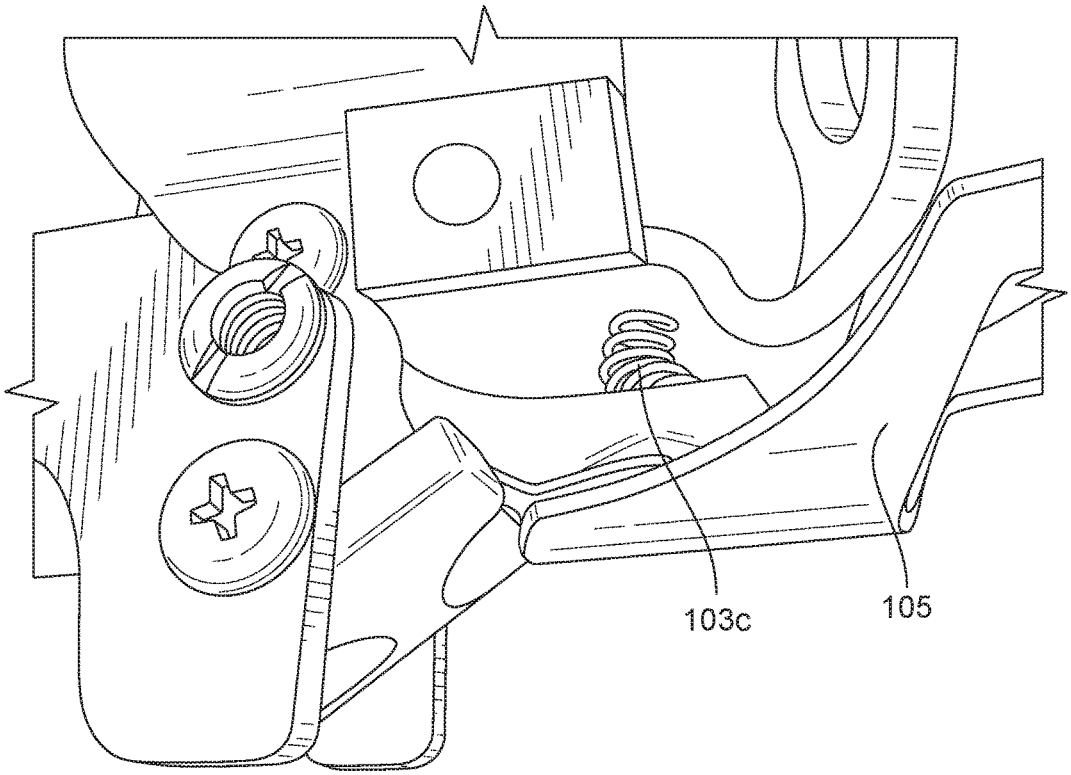
FIG. 1I is a side perspective view of the anchor system, lever, and actuator of the embodiment of FIG. 1A, shown in an actuated position.
Figure 1J:
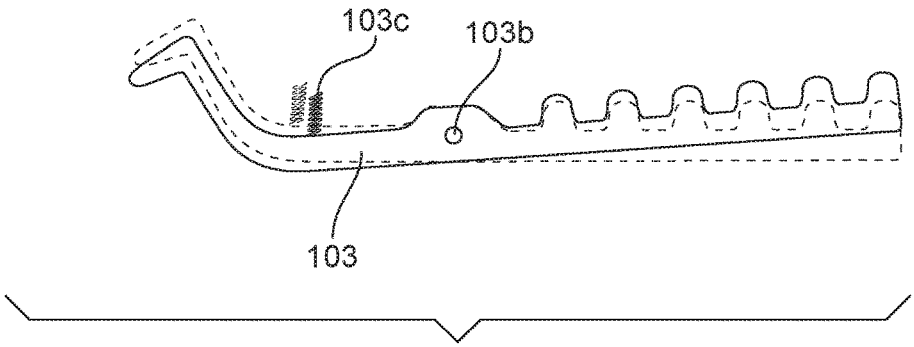
FIG. 1J is a side view of the lever of the embodiment of FIG. 1A, shown between latched and unlatched positions.
Figure 1K:
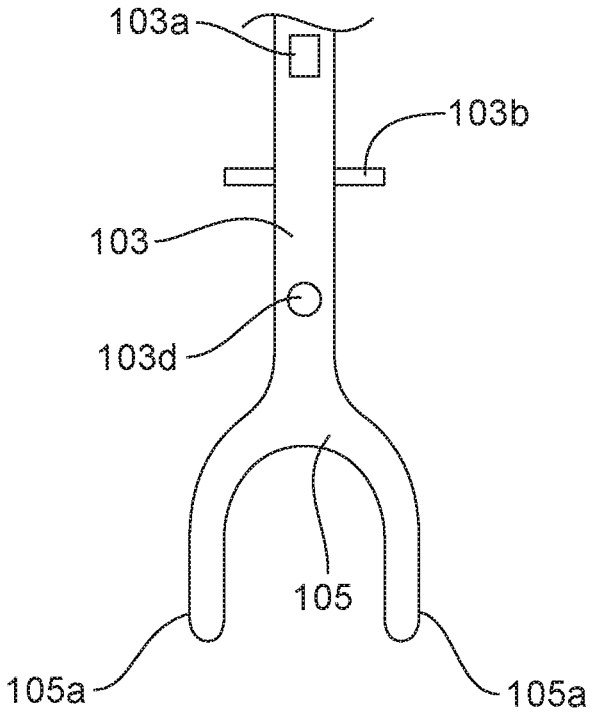
FIG. 1K is a top view of the lever of the embodiment of FIG. 1A, showing dual stems for ambidextrous use.
Figure 1L:
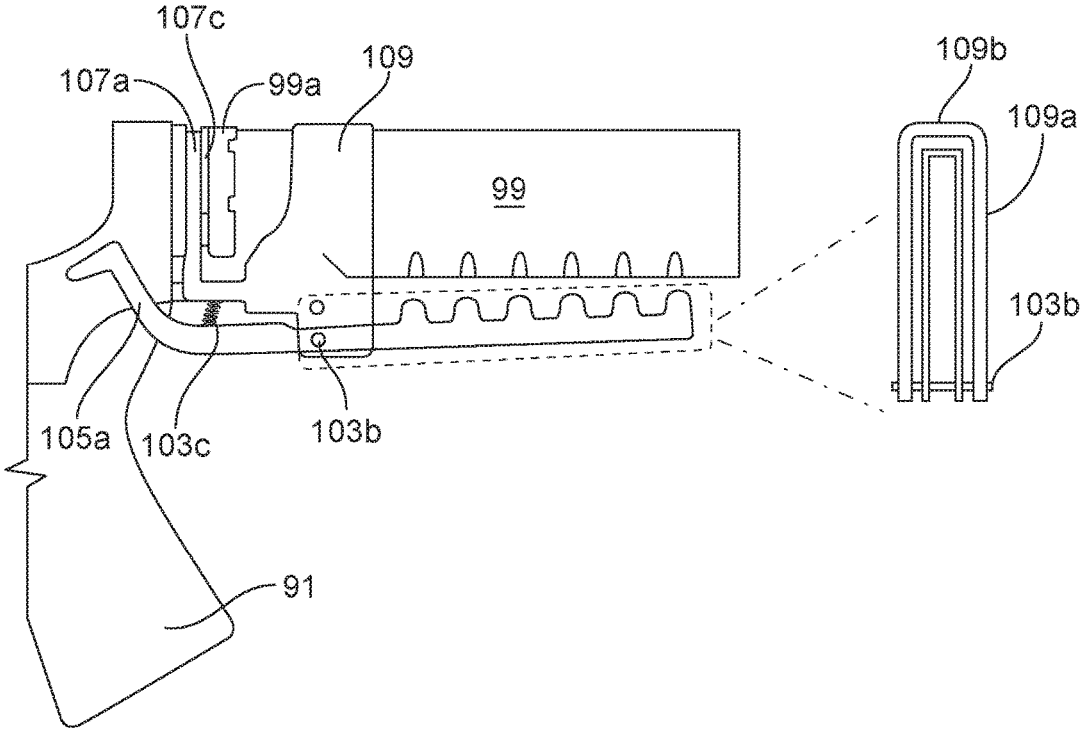
FIG. 1L is a side schematic view of the anchor, lever, and actuator of the embodiment of FIG. 1A, shown disposed on a buffer tube of a firearm.
Figure 1M:
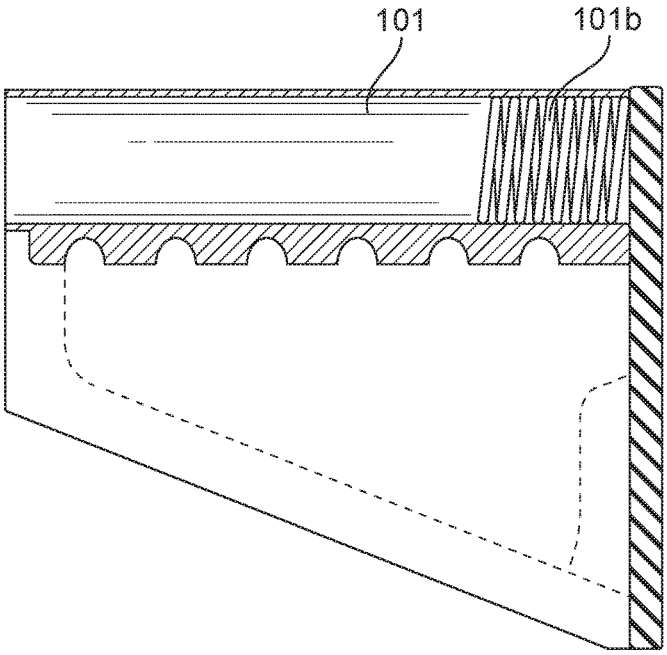
FIG. 1M is a cross-sectional view of the buttstock of the embodiment of FIG. 1A, shown having an internal spring disposed therein.
Figure 1N:
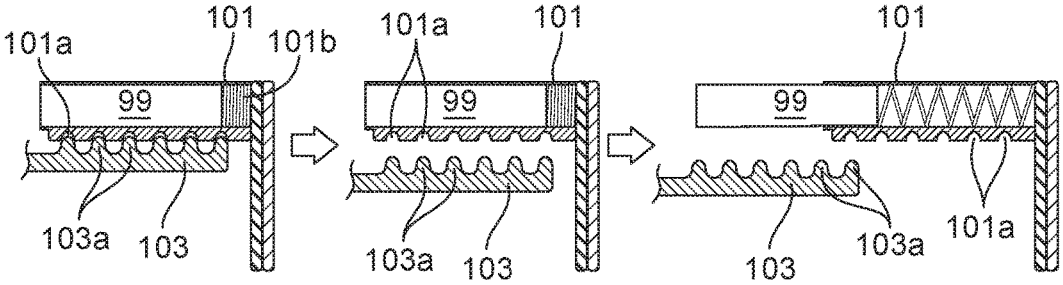
FIG. 1N shows various cross-sectional views of the buttstock and the lever of FIG. 1A, the buttstock shown in the collapsed position and the lever shown in the latched position (on the left), the lever shown in the unlatched position (in the middle just before the buttstock moves toward the extended position), and the buttstock shown in the extended position with the lever in the unlatched position (on the right)
Figure 10:
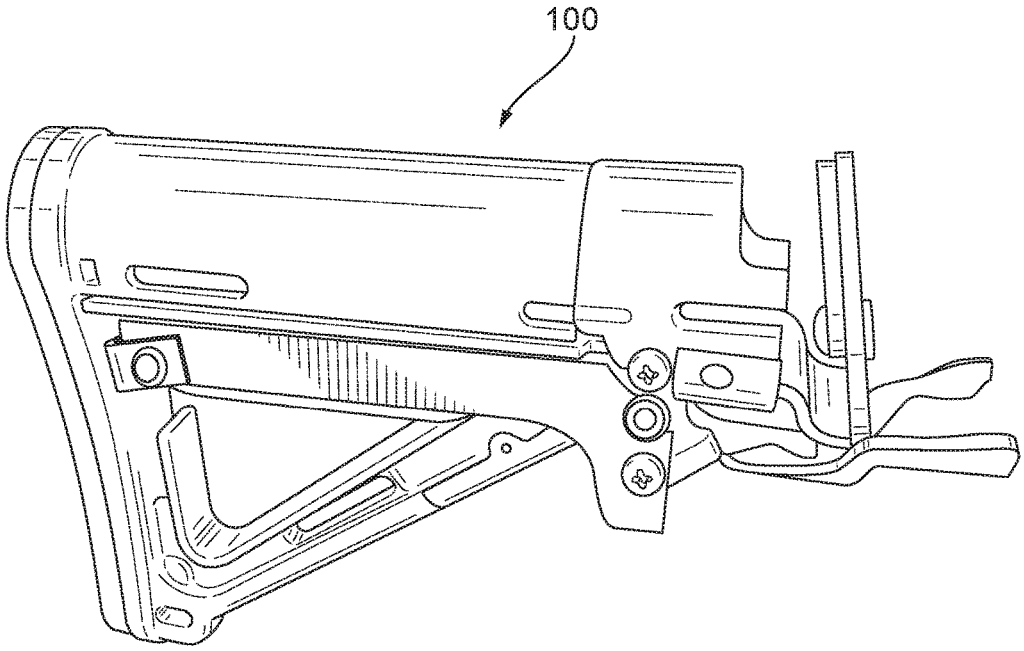

Referring additionally to FIGS. 1B, 1D, 1J, and 1N the system 100 also includes a lever 103 having one or more lever teeth 103*a* configured to mate with the plurality of buttstock grooves 101*a* in a latched position (e.g., left side of FIG. 1N). The lever 103 can include any suitable number of lever teeth 103*a* and can have any suitable shape and/or size configured to mate with the plurality of buttstock grooves 101*a* in the latched position. In certain embodiments, the lever teeth 103*a* can increase in size/length toward a rear portion of the lever 103.

The lever 103 is configured to mount to the firearm and to be moveable (e.g., rotatable as shown in FIG. 1J) relative to the buttstock 101 between the latched position (e.g., left side of FIG. 1N) and an unlatched position (middle and right portions of FIG. 1N). In certain embodiments, the lever 103 can be configured to be mounted to the firearm via a hinge 103*b* (e.g., see FIGS. 1J and 1L). Any other suitable mounting to allow relative movement is contemplated herein.

In the latched position, the buttstock 101 cannot slide relative to the firearm because the lever teeth 103*a* are communicating with the buttstock grooves 101*a*. In the unlatched position, the buttstock 101 is free to slide relative to the firearm because the lever teeth 103*a* are clear of the buttstock grooves 101*a*.

The lever 103 can be biased to the latched position. For example, as shown in FIGS. 1H, 1I, and 1J, the lever 103 can be operatively associated with a lever spring 103*c*. As shown in FIG. 1K, the lever 103 can include a spring detent 103*d* for retaining an end of the lever spring 103*c*. The lever 103 can also include a lever cover (not shown) for protecting the lever from the elements.

Referring to FIG. 1A, the system 100 also includes an actuator 105 attached and/or forming part of the lever 103 to move the lever 103 between the latched position and the unlatched position. The actuator 105 can be configured to be positioned adjacent a grip 91 of the firearm when the system 100 is installed on a firearm. In this regard a user can actuate the lever without removing a hand from the grip 91.

In certain embodiments, the actuator 105 can be configured to be positioned above or otherwise adjacent to a thumb or other suitable digit of the user when the system 100 is installed on the firearm such that the user's thumb or other digit can actuate the actuator 105. For example, as shown the actuator 105 can be configured to be pushed upward by the user's thumb to move the lever 103 to the unlatched position. It is contemplated that the actuator 105 can be configured to be pushed and/or pulled at least one of upward, downward, laterally, forward, and/or backward by the user's thumb and/or any other suitable digit to move the lever to the unlatched position. In certain embodiments, e.g., as in an AR-15 or similar rifle, the actuator 105 can be positioned near and/or just above a safety selector without interfering with operation of the safety selector. Any suitable linkage of the actuator 105 to the lever 103 to cause actuation of the lever 103 by the actuator 105 as a result of any suitable actuator motion is contemplated herein.

Referring additionally to FIG. 1E, the actuator 105 can extend from the lever 103 via one or more stems 105*a* that bends off of a longitudinal axis of the lever 103 and around the grip 91 of the firearm. As shown in FIGS. 1H and 1I, the stems 105*a* can be pressed upward to actuate the lever 103 against the force of the lever spring 103*c*. In certain embodiments, as shown in FIGS. 1E and 1K, the actuator 105 can include a duel stem 105*a* (e.g., forming a Y-like shape) extending from the lever 103 to each side of the grip 91 to allow ambidextrous actuation. Any other suitable actuation mechanism is contemplated herein.

While the grip 91 shown as the pistol grip adjacent a trigger assembly, it is contemplated that one or more stems 105*a* can be dimensioned to extend any suitable length to reach any suitable grip (e.g., a fore grip). It is also contemplated that the actuator 105 (e.g., for thumb actuation) could be used with any suitable latch/unlatch system to allow the buttstock 101 to move (slidably, rotatably, or otherwise) and does not necessarily have to be used with embodiments as disclosed herein (e.g., which use lever 103 and buttstock 101).

Referring to FIG. 1A-1H, the system 100 can further include an anchor system 107. In the embodiments shown herein, the anchor system 107 is configured to allow the system 100 to be a drop-in attachment to a standard buffer tube assembly. However, it is contemplated that the anchor system 107 can be configured to mount the system 100 to any suitable portion of a firearm and/or may form part of a firearm and/or may not be designed for easy installation or removal.

As shown, the anchor system 107 can be configured to be positioned in front of a castle nut 99*a* of a buffer tube 99 of the firearm in an open position (e.g., as shown in FIGS. 1B-1E). The anchor system 107 can be configured to then clamp around the buffer tube 99 to be compressed by the castle nut 99*a* in a closed position (e.g., as shown in FIGS. 1F and 1G).

Referring to FIGS. 1E and 1L, the anchor system 107 can include a base plate 107*a* defining an opening 107*b* dimensioned to slide over the buffer tube 99 past the castle nut 99*a*. The base plate 107*a* can include any suitable shape. For example, the base plate 107*a* is depicted as a continuous circular piece, however, it is contemplated that any other suitable shape (e.g., a half moon or other discontinuous shape) can be utilized.

The anchor system 107 can further include a pair of arms 107*c* moveably mounted to the base plate 107*a* to move between the open position (e.g., FIG. 1E) and the closed position (e.g., FIG. 1G). The arms 107*c* can clamp against the buffer tube 99 in the closed position such that the castle nut 99*a* can be compressed against the arms 107*c* in the closed position to retain the anchor assembly 107. For example, referring additionally to FIG. 1G, the arms 107*c* can form a smaller opening than opening 107*b* when the arms 107*c* are in the closed position, which is smaller than the outer diameter of the castle nut 99*a*. In certain embodiments, where the base plate 107*a* is discontinuous, when the arms 107 are closed, they can create an enclosed circular piece which anchors the system in front of the castle nut and into the actual base plate of a buffer tube assembly.

Certain AR-15 receiver end plates have a recessed area at the bottom of the part. For such firearms, the anchor system 107 can include a notch (formed on the base plate 107*a*) that fills this recessed area. By fitting into the small circular recessed area of the receiver end plate, the system 100 can be prevented from having any lateral movement/play on the buffer tube 99.

Referring additionally to FIGS. 3A-3D, an embodiment of a system 300 is shown including an anchor system 107 where the base plate 107*a* and arms 107*c* are combined into clamp arms 307. The clamp arms 307 can include a latch feature 308 (e.g., a protrusion that fits into an aperture on the other arm 307 or any other suitable latch mechanism) configured to removably lock the arms 307 together when closed. Also shown is an embodiment of an ambidextrous actuator 305 having two sides that fit around the grip.

Referring to FIG. 1A, 1L, and the system 100 can further include a buffer tube collar 109 fixed to the anchor system 107 (e.g., as a separate part or forming part of the anchor system 107). The buffer tube collar 109 can be configured to position around the buffer tube 99 behind the castle nut 99*a* and to prevent rotation of the anchor system 107 about the buffer tube 99 (e.g., by gripping buffer tube rail 99*b*). As shown, in certain embodiments, the buffer tube collar 109 can include the hinge 103*b* for lever 103 such that the lever 103 can mounted to the buffer tube collar 109 (e.g., via a suitable pin or other fastener) to allow the lever 103 to move between a latched position and an unlatched position.

Referring to FIGS. 1A, 1C, and 1D, in certain embodiments, the buffer tube collar 109 can further include at least one guide rail 109*a* extending therefrom and a buttstock stop 109*b* for stopping a buttstock 101 at an extended position. The guide rail 109*a* and the buttstock stop 109*b* can be separate components as shown, or can be formed from a single piece to form a U-shaped member as shown in FIG. 1L. Any suitable stopping mechanism is contemplated herein. For example, a lower cover (not shown) can include a wall located at rear position that acts as a stop when the buttstock 101 is fully extended.

The buttstock 101 can be biased to the at least one extended position. For example, referring to FIG. 1M, the buttstock 101 can be biased with one or more internal springs 101*b* disposed within the buttstock 101. As disclosed above, certain embodiments of the buttstock 101 can be configured to be slidably mounted over a buffer tube 99 of the firearm. In such embodiments, the internal spring 101*b* can be positioned between the buffer tube 99 and an internal surface of the buttstock 101 to bias the buttstock 101 to the at least one extended position (as shown in FIG. 1N).

Figure 2A:
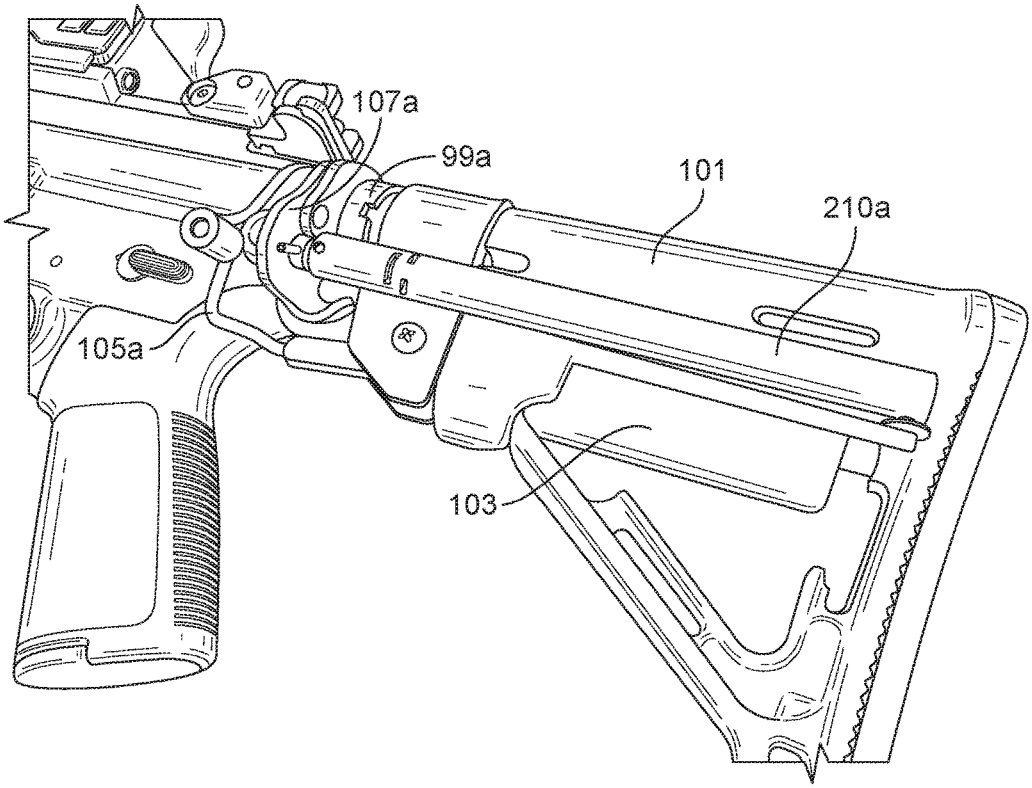
FIG. 2A is a perspective view of an embodiment of a system in accordance with this disclosure, shown in a collapsed position and having a telescoping external spring.
Figure 2B:
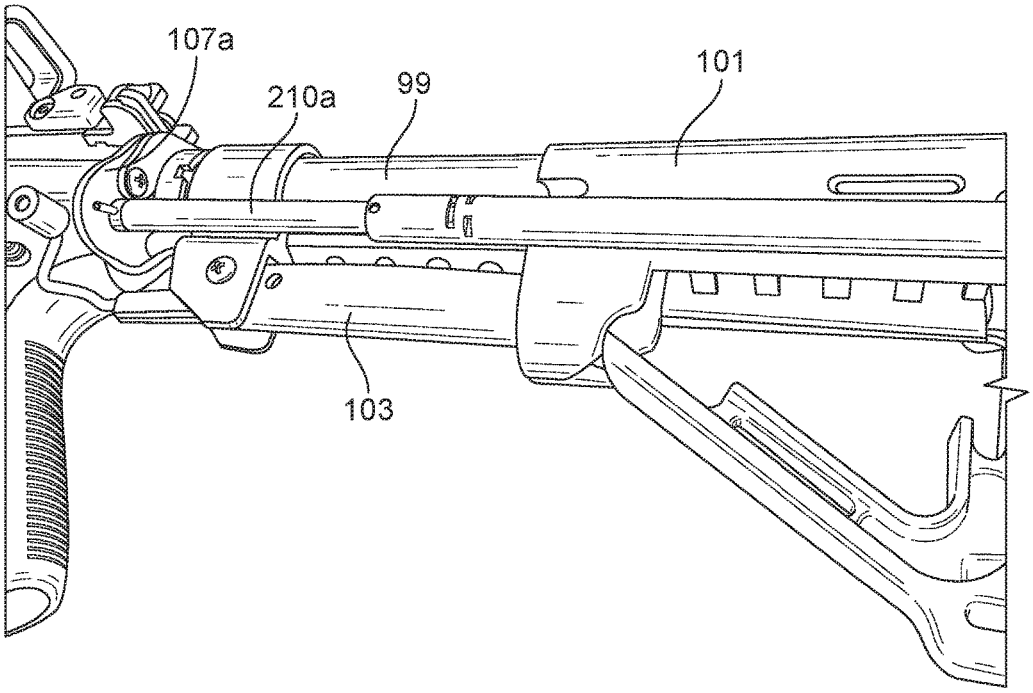
FIG. 2B is a perspective view of the embodiment FIG. 2A, shown in an extended position.
Figure 3A:
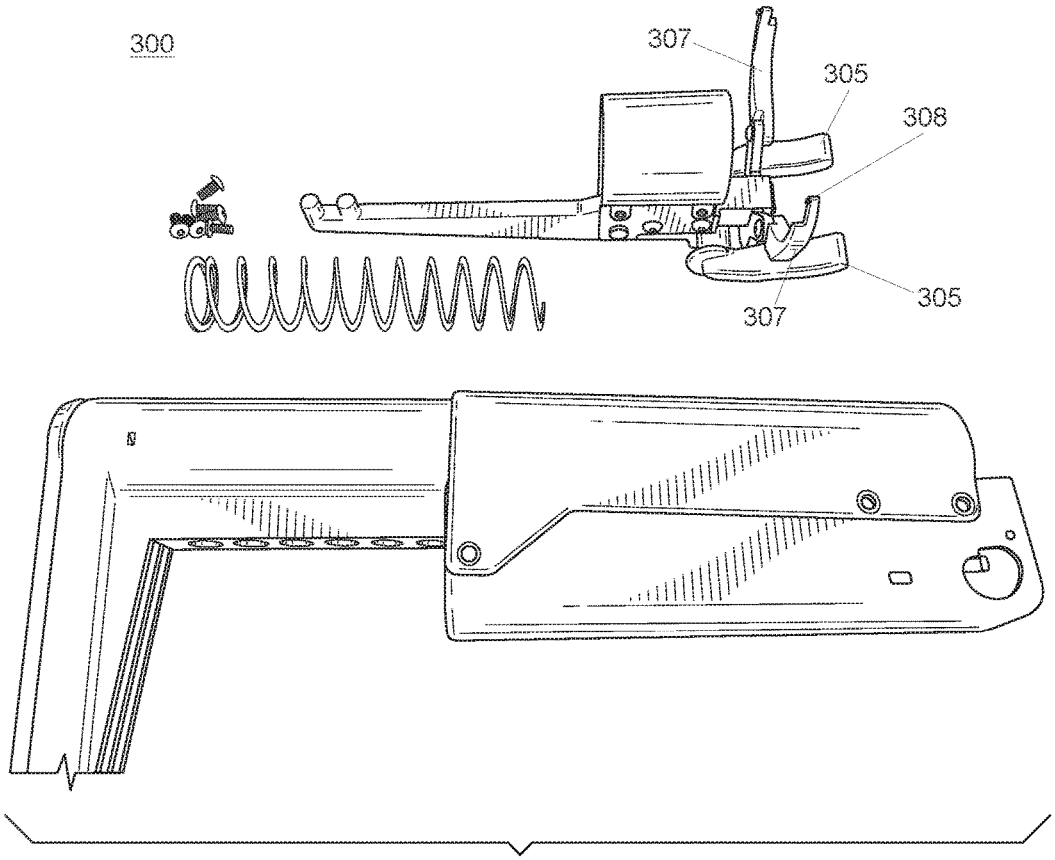
FIGS. 3A-3D show various views of an embodiment of a system in accordance with this disclosure.
Figure 3B:
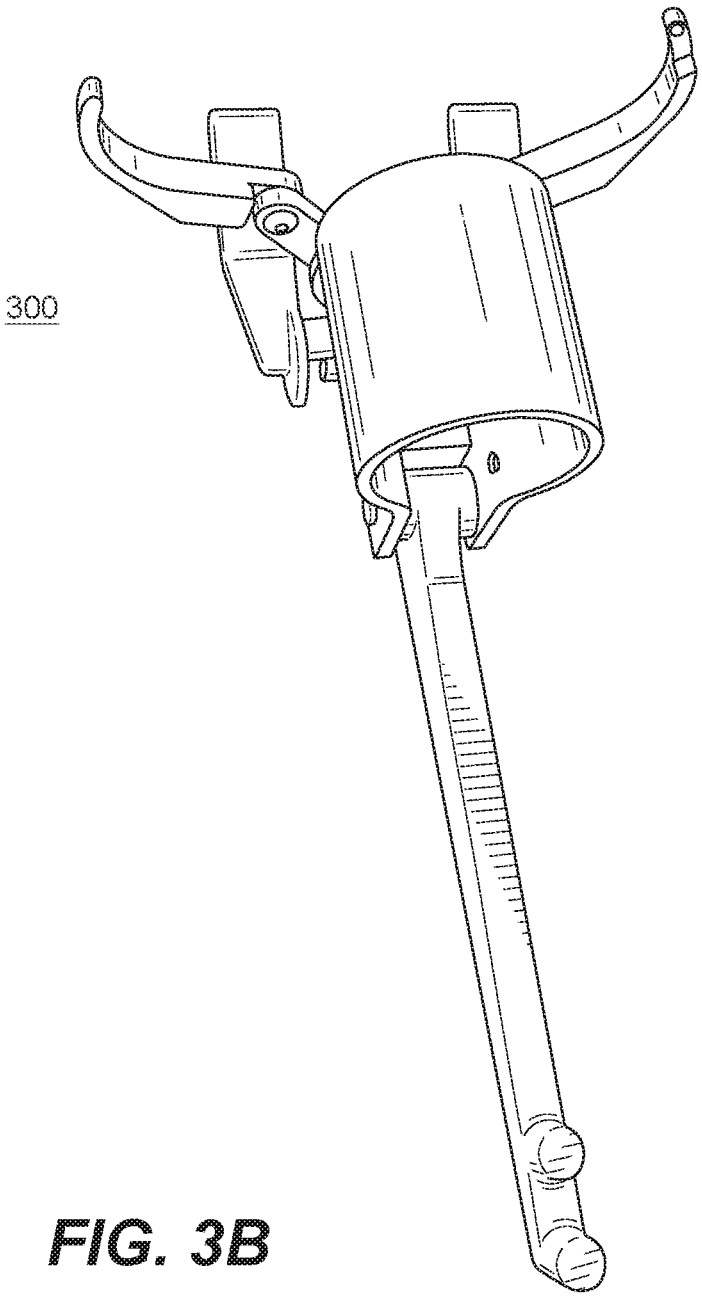
Figure 3C:
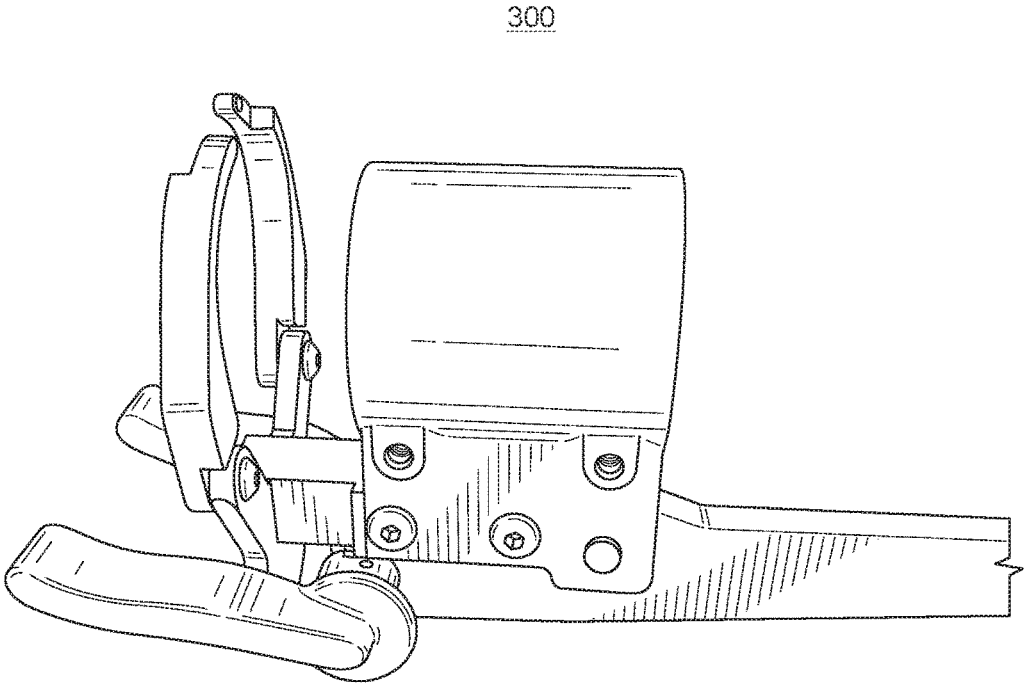
Figure 3D:
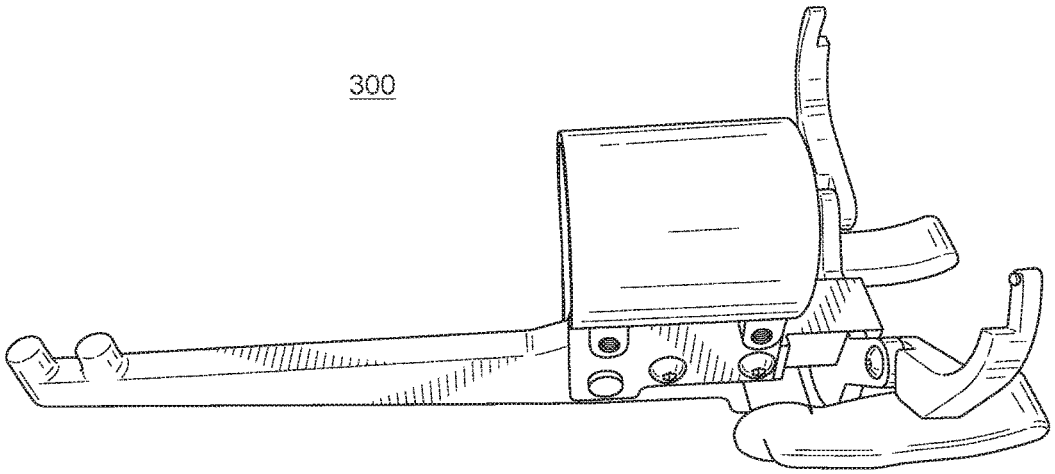

However, referring to FIGS. 2A and 2B, the buttstock 101 can additionally or alternatively be biased with one or more external springs mounted outside of the buttstock 101. For example, the system 100 can further include at least one telescoping spring mechanism 201*a* mounted at one end to the base plate 107*a*. The telescoping spring mechanism 201*a* can be mounted at an opposite end to the buttstock 201*a* to bias the buttstock 101 to at least one extended position. In this regard, it is possible to remove guide rail 109*a* and/or buttstock stop 109 as the telescoping spring mechanism 201 can act a guide and/or a stop.

While certain embodiments of biasing are described above (e.g., via internal and/or external springs), any other suitable biasing system (e.g., pressure actuated) is contemplated herein. Also, it is contemplated that no biasing is necessary, and that systems as described above (e.g., anchoring systems, thumb actuators) can be utilized in embodiments having no biasing.

Also, while this disclosure shows the "collapsed position" as pushed inward and the one or more "extended positions" as extending further from the firearm via a sliding motion, it is contemplated that the terms can be generically applied to any first stowed position and any second position. For example, the "collapsed position" could additionally or alternatively refer to a folded position for a folding stock and the "extended position" could be an unfolded position. One having ordinary skill in the art understands that various portions of this disclosure can be modified and/or applied to any suitable type of fixed stock or adjustable stock, and for any suitable firearm.

Certain embodiments as described above allow a user (e.g., of a shoulder fired weapon) to expand and collapse the buttstock 101 of a firearm without ever having to remove one or both hands from the firearm. For example, if the buttstock is too short, a user can actuate the actuator 105 (e.g., by pushing up with a thumb) to move the lever 103 to the unlatched position. In embodiments that are biased, the buttstock 101 will move to a more extended position while the lever 103 is in the unlatched position. The user can select any suitable extended position (e.g., by resisting the force of the bias with the users shoulder until the buttstock as reached a desired extended position), or the user can allow the buttstock 101 to extend to the maximum extension (e.g., until the buttstock 101 hits the buttstock stop 109*b* and/or to a maximum extension of the telescoping spring mechanism 201*a*). At the desired position or at maximum extension, the user can then release the actuator and allow the lever 103 to spring back into contact with the buttstock 101 to prevent the buttstock 101 from moving back toward the collapsed position. To move the buttstock 101 back to the collapsed position, the user can actuate the actuator 105 and compress the buttstock 105 (e.g., using a shoulder) until a desired collapsed position is reached.

Embodiments of this disclosure are drop in capable for easy installation and/or removal from standard mil-spec buffer tubes and components thereof, which eliminated the need to purchase any other third parties accessories or remove any integral parts of a standard firearm (e.g., an AR-15).

As described above, certain embodiments include an ambidextrous lever extension system that fits alongside the left and right side of the lower receiver giving the user the ability to use the stock system 100 ambidextrously without ever taking a hand off the firearm and without changing their "firing grip," which can be maintain accurate firing while allowing adjustment of the buttstock 101. Embodiments also allow the ability to create an activation point of the system 100 (e.g., by placing the actuator at any other suitable position) if the user does not want an ambidextrous lever to extend alongside the receiver for whatever purpose.

Embodiments that allow the buttstock 101 to be manipulated without removing either hand from the weapon can protect the user where removing one's hand from the weapon could prove fatal for that user. Additionally, embodiments having the lever 103 and the buttstock 101 as disclosed above do not require the use of the buffer tube 99 or any holes of the buffer tube 99. In that respect, such embodiments are self-contained extension systems that can install on any firearm or component thereof without modification or the need to limit the design to buffer tube specifications. It is contemplated that embodiments as described above can be used on any suitable device (e.g., an airsoft gun, a crossbow), and is not limited to use with firearms or particular models of firearms.

The methods and systems of the present disclosure, as described above and shown in the drawings, provide for buttstock systems with superior properties. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. An adjustable stock system for a firearm, comprising:

a buttstock configured to be slidably attached to the firearm for moving relative to the firearm between a collapsed position and at least one extended position, wherein the buttstock includes a plurality of buttstock grooves defined therein;

a lever including at least one lever tooth configured to mate with the plurality of buttstock grooves in a latched position, the lever configured to mount to the firearm and to be moveable relative to the buttstock between the latched position where the buttstock cannot slide relative to the firearm, and an unlatched position where the buttstock is free to slide relative to the firearm, wherein the lever is biased to the latched position; and an actuator configured to move the lever between the latched position and the unlatched position, wherein buttstock is biased to the at least one extended position, wherein the buttstock is biased with one or more internal springs disposed within the buttstock, wherein the buttstock is configured to be slidably mounted over a buffer tube of the firearm, wherein the one or more internal springs are positioned between the buffer tube and an internal surface of the butt stock to bias the buttstock to the at least one extended position.

2. The system of claim 1, wherein the lever includes a plurality of lever teeth configured to mate with the plurality of buttstock grooves in a latched position.

3. The system of claim 1, wherein the lever is configured to be mounted to the firearm via a hinge.

4. The system of claim 1, wherein the actuator is configured to be positioned adjacent a grip of the firearm when the system is installed on a firearm such that a user can actuate the lever without removing a hand from the grip.

5. The system of claim 4, wherein the actuator is configured to be positioned above a thumb of the user when the system is installed on the firearm such that the user's thumb can actuate the actuator.

6. The system of claim 1, further comprising an anchor system configured to be positioned in front of a castle nut of a buffer tube of the firearm in an open position, and to clamp around the buffer tube to be compressed by the castle nut in a closed position.

7. The system of claim 6, wherein the anchor system includes:

a base plate defining an opening dimensioned to slide over the buffer tube past the castle nut; and a pair of arms moveably mounted to the base plate to move between the open position and the closed position, wherein the arms clamp against the buffer tube in the closed position such that the castle nut can be compressed against the arms in a closed position to retain the anchor assembly.

8. An adjustable stock system for a firearm, comprising:

a buttstock configured to be slidably attached to the firearm for moving relative to the firearm between a collapsed position and at least one extended position, wherein the buttstock includes a plurality of buttstock grooves defined therein;

a lever including at least one lever tooth configured to mate with the plurality of buttstock grooves in a latched position, the lever configured to mount to the firearm and to be moveable relative to the buttstock between the latched position where the buttstock cannot slide relative to the firearm, and an unlatched position where the buttstock is free to slide relative to the firearm, wherein the lever is biased to the latched position;

an actuator configured to move the lever between the latched position and the unlatched position; and an anchor system configured to be positioned in front of a castle nut of a buffer tube of the firearm in an open position, and to clamp around the buffer tube to be compressed by the castle nut in a closed position, wherein the anchor system includes:

a base plate defining an opening dimensioned to slide over the buffer tube past the castle nut; and a pair of arms moveably mounted to the base plate to move between the open position and the closed position, wherein the arms clamp against the buffer tube in the closed position such that the castle nut can be compressed against the arms in a closed position to retain the anchor assembly.

9. An adjustable stock system for a firearm, comprising:

a buttstock configured to be slidably attached to the firearm for moving relative to the firearm between a collapsed position and at least one extended position, wherein the buttstock includes a plurality of buttstock grooves defined therein, wherein buttstock is configured to be biased to the at least one extended position, wherein the buttstock is configured to be slidably mounted over a buffer tube of the firearm;

a lever including at least one lever tooth configured to mate with the plurality of buttstock grooves in a latched position, the lever configured to mount to the firearm and to be moveable relative to the buttstock between the latched position where the buttstock cannot slide relative to the firearm, and an unlatched position where the buttstock is free to slide relative to the firearm, wherein the lever is biased to the latched position;

an actuator configured to move the lever between the latched position and the unlatched position; and one or more internal springs disposed within the buttstock and configured to bias the buttstock to the at least one extended position, wherein the one or more internal springs are positioned within the buttstock to be between the buffer tube and an internal surface of the buttstock when the buttstock is mounted to the buffer tube to bias the buttstock to the at least one extended position.

10. The system of claim 9, wherein the lever includes a plurality of lever teeth configured to mate with the plurality of buttstock grooves in a latched position.

11. The system of claim 9, wherein the lever is configured to be mounted to the firearm via a hinge.

12. The system of claim 9, wherein the actuator is configured to be positioned adjacent a grip of the firearm when the system is installed on a firearm such that a user can actuate the lever without removing a hand from the grip.

13. The system of claim 12, wherein the actuator is configured to be positioned above a thumb of the user when the system is installed on the firearm such that the user's thumb can actuate the actuator.

14. The system of claim 9, further comprising an anchor system configured to be positioned in front of a castle nut of a buffer tube of the firearm in an open position, and to clamp around the buffer tube to be compressed by the castle nut in a closed position.

15. The system of claim 14, wherein the anchor system includes:

a base plate defining an opening dimensioned to slide over the buffer tube past the castle nut; and a pair of arms moveably mounted to the base plate to move between the open position and the closed position, wherein the arms clamp against the buffer tube in the closed position such that the castle nut can be compressed against the arms in a closed position to retain the anchor assembly.

* * * * *